US007905193B2

(12) United States Patent
Beamer

(10) Patent No.: US 7,905,193 B2
(45) Date of Patent: Mar. 15, 2011

(54) TRIM TABS

(75) Inventor: Gregory Paul Beamer, Mankato, MN (US)

(73) Assignee: Johnson Outdoors Inc., Mankato, MN (US)

( * ) Notice: Subject to any disclaimer, the term of this patent is extended or adjusted under 35 U.S.C. 154(b) by 558 days.

(21) Appl. No.: 12/005,977

(22) Filed: Dec. 28, 2007

(65) Prior Publication Data

US 2009/0165694 A1 Jul. 2, 2009

(51) Int. Cl.
*B63B 1/22* (2006.01)
*B63B 39/06* (2006.01)

(52) U.S. Cl. ..... 114/285

(58) Field of Classification Search ..... 114/264–286; 440/66; D12/309, 317
See application file for complete search history.

(56) References Cited

U.S. PATENT DOCUMENTS

| | | | | |
|---|---|---|---|---|
| 3,046,928 | A | 7/1962 | Sherrill | |
| 3,085,537 | A * | 4/1963 | Headrick et al. | 114/278 |
| 3,177,837 | A | 4/1965 | Sherrill | |
| 3,327,671 | A | 6/1967 | Comins | |
| 3,628,487 | A | 12/1971 | Bennett | |
| 3,695,204 | A | 10/1972 | Bennett | |
| 3,814,044 | A * | 6/1974 | Kercheval | 114/286 |
| 3,977,349 | A | 8/1976 | Hummel | |
| 4,232,626 | A | 11/1980 | Kern | |
| 4,261,278 | A | 4/1981 | Gaudin | |
| 4,323,027 | A * | 4/1982 | Schermerhorn | 114/285 |
| 4,401,888 | A | 8/1983 | West et al. | |
| 4,420,741 | A | 12/1983 | West | |
| 4,424,041 | A | 1/1984 | Sietmann et al. | |
| 4,644,893 | A | 2/1987 | Zepp | |
| D292,392 | S | 10/1987 | Zepp et al. | |
| 4,708,672 | A | 11/1987 | Bentz et al. | |
| 4,742,794 | A | 5/1988 | Hagstrom | |
| 4,749,926 | A | 6/1988 | Ontolchik | |
| 4,832,642 | A | 5/1989 | Thompson | |
| 4,854,259 | A | 8/1989 | Cluett | |
| 4,896,622 | A | 1/1990 | Thomas | |
| 4,909,175 | A | 3/1990 | Arnseson | |
| 4,967,682 | A | 11/1990 | O'Donnell | |
| 5,017,165 | A | 5/1991 | Havins | |
| D317,431 | S * | 6/1991 | Klus | D12/317 |
| 5,058,520 | A | 10/1991 | Fahrney | |
| 5,113,780 | A | 5/1992 | Bennett et al. | |
| 5,117,741 | A | 6/1992 | Richards | |
| 5,142,473 | A | 8/1992 | Davis | |
| D335,484 | S * | 5/1993 | Moyle et al. | D12/317 |

(Continued)

OTHER PUBLICATIONS

"Wayback Machine" retrieval of web documents from minnkotamotors.com.*

(Continued)

*Primary Examiner* — Ajay Vasudeva
(74) *Attorney, Agent, or Firm* — Reinhart Boerner Van Deuren P.C.

(57) ABSTRACT

A trim tab for mounting the transom of a boat has an upper surface and an undulating bottom surface with down-turned flaps on opposite sides of the tab. The trim tab is formed of a molded composite material. The top surface includes a hinge platform at its forward end and mount platform at a rearward end. The trim tab tapers from a minimum thickness at its leading end to a maximum thickness at its trailing end. The shape of the bottom surface and the down-turned flaps provide a bottom surface area with enhanced lift characteristics.

20 Claims, 14 Drawing Sheets

U.S. PATENT DOCUMENTS

| | | | | |
|---|---|---|---|---|
| 5,215,029 | A | | 6/1993 | Davis |
| 5,263,432 | A | | 11/1993 | Davis |
| 5,350,327 | A | | 9/1994 | Self et al. |
| 5,383,419 | A | | 1/1995 | Stevens |
| 5,385,110 | A | | 1/1995 | Bennett et al. |
| 5,443,026 | A | | 8/1995 | Wenstadt et al. |
| 5,474,012 | A | | 12/1995 | Yamada et al. |
| 5,474,013 | A | | 12/1995 | Wittmaier |
| 5,524,567 | A | | 6/1996 | Astley et al. |
| D375,101 | S | * | 10/1996 | Icenogle ..... D15/4 |
| D378,813 | S | * | 4/1997 | Jacques ..... D12/317 |
| 5,704,308 | A | | 1/1998 | Anderson |
| D392,936 | S | * | 3/1998 | Koyanagi ..... D12/317 |
| 5,832,863 | A | | 11/1998 | Sherlock |
| 5,842,895 | A | | 12/1998 | DeVito, Jr. |
| 5,878,686 | A | | 3/1999 | Anderson |
| 5,881,666 | A | | 3/1999 | Crews, Jr. |
| 6,085,684 | A | | 7/2000 | Cotton |
| 6,089,177 | A | | 7/2000 | Müller |
| 6,095,077 | A | | 8/2000 | DeAgro |
| 6,132,267 | A | | 10/2000 | Campbell |
| 6,138,601 | A | | 10/2000 | Anderson et al. |
| 6,167,830 | B1 | | 1/2001 | Pilger |
| 6,174,210 | B1 | | 1/2001 | Spade et al. |
| 6,254,513 | B1 | | 7/2001 | Takenaka et al. |
| 6,273,771 | B1 | | 8/2001 | Buckley et al. |
| 6,280,269 | B1 | | 8/2001 | Gaynor |
| 6,354,237 | B1 | | 3/2002 | Gaynor et al. |
| 6,493,905 | B2 | | 12/2002 | Stettler |
| 6,520,813 | B1 | | 2/2003 | DeVito, Jr. |
| 6,524,146 | B2 | | 2/2003 | Spade et al. |
| 6,571,724 | B1 | | 6/2003 | Shen |
| 6,583,728 | B1 | | 6/2003 | Staerzl |
| 6,588,360 | B1 | | 7/2003 | Bachmann |
| 6,745,715 | B1 | | 6/2004 | Shen et al. |
| 6,805,068 | B1 | | 10/2004 | Tossavainen |
| 6,823,812 | B2 | | 11/2004 | von Wolske |
| 6,863,581 | B2 | | 3/2005 | Anderson |
| 6,941,884 | B2 | | 9/2005 | Moore |

OTHER PUBLICATIONS

Minn Kota "Trim Tabs" brochure (in color), Jul. 2006 (4 pages).

* cited by examiner

TRIM TABS

BACKGROUND

The present invention relates to trim tabs mounted to the transom or underside the hull of a boat. In particular, the trim tabs are molded composite material elements shaped to provide light weight and enhanced lift characteristics.

Trim tabs typically have been in the form of flat stainless steel plates that are pivotally attached to the transom or hull of the boat. Trim tabs of different sizes are used, depending upon the size of the boat.

In one typical configuration, at least one trim tab is pivotally mounted on the left or port side and at least one trim tab is pivotally mounted on the right or starboard side of the transom. In other cases, a single center mounted trim tab is used. The trim tabs are raised and lowered by a drive mechanism. Earlier trim tab systems used mechanical jack screws to raise and lower the trim tabs. Currently available systems use either hydraulic or electromechnical actuators to raise and lower the trim tabs.

Trim tabs are used to provide additional boat control for reasons such as uneven load distribution in the boat, controlling bow attitude in various water conditions, and trimming the boat out of the water faster in conditions such as shallow water operation. Depending on the type of boat and the number and position of occupants, the attitude (or side-to-side angle along the keel) can tilt left or right. Trim tabs can improve boat performance by leveling the boat. Trim tabs can also be used to increase top end speed, to improve "hole-shot", and to provide a drier ride by keeping the nose down and the boat up on plane.

SUMMARY

A trim tab features a tapered body that increases in thickness from a leading end to a trailing end and has a bottom surface with convex and concave sections. On the lateral edges of the trim tab, down-turned flaps extend the length of the trim tab. The contoured bottom surface and down-turned side flaps provide an increased bottom surface area that can provide an enhancement in lift characteristics for a given trim tab size.

DETAILED DESCRIPTION

Figure 1A:
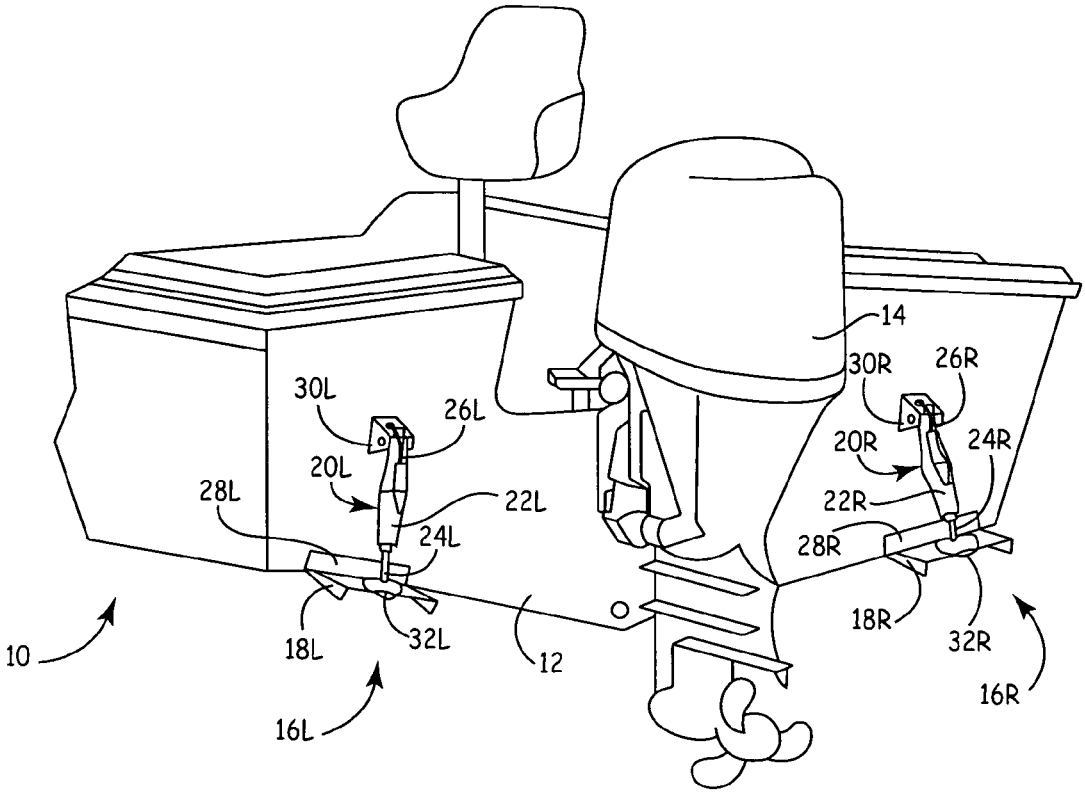
FIG. 1A is a perspective view of a stern of a boat with trim tabs mounted to the lower transom.

FIG. 1A shows the stem of boat 10 that includes a trim tab system. Mounted on transom 12 are outboard motor 14, left trim tab assembly 16L, and right trim tab assembly 16R.

Left trim tab assembly 16L includes left trim tab 18L, linear actuator 20L (which includes actuator housing 22L, actuator rod 24L, and electrical cable 26L), hinge 28L, upper mounting bracket 30L, and lower mount 32L. Similarly, right trim tab assembly 16R includes trim tab 18R, linear actuator 20R (which includes actuator body 22R, actuator rod 24R, and cable 26R), hinge 28R, upper mounting bracket 30R, and lower mount 32R.

Hinges 28L and 28R pivotally connect trim tabs 18L and 18R to transom 12. Linear actuators 20L and 20R are connected between upper brackets 30L and 30R on transom 12 and lower mounts 32L and 32R on trim tabs 18L and 18R, respectively. Actuators 20L and 20R are, in one embodiment, electromechanical actuators that receive electrical power and provide feedback signals through cables 26L and 26R.

Trim tabs 18L and 18R operate in a trim range from about 0° (horizontal) to about 20° below horizontal. Trim tabs 18L and 18R can be individually adjusted within the trim range, or can be adjusted together by equal amounts.

Figure 1B:
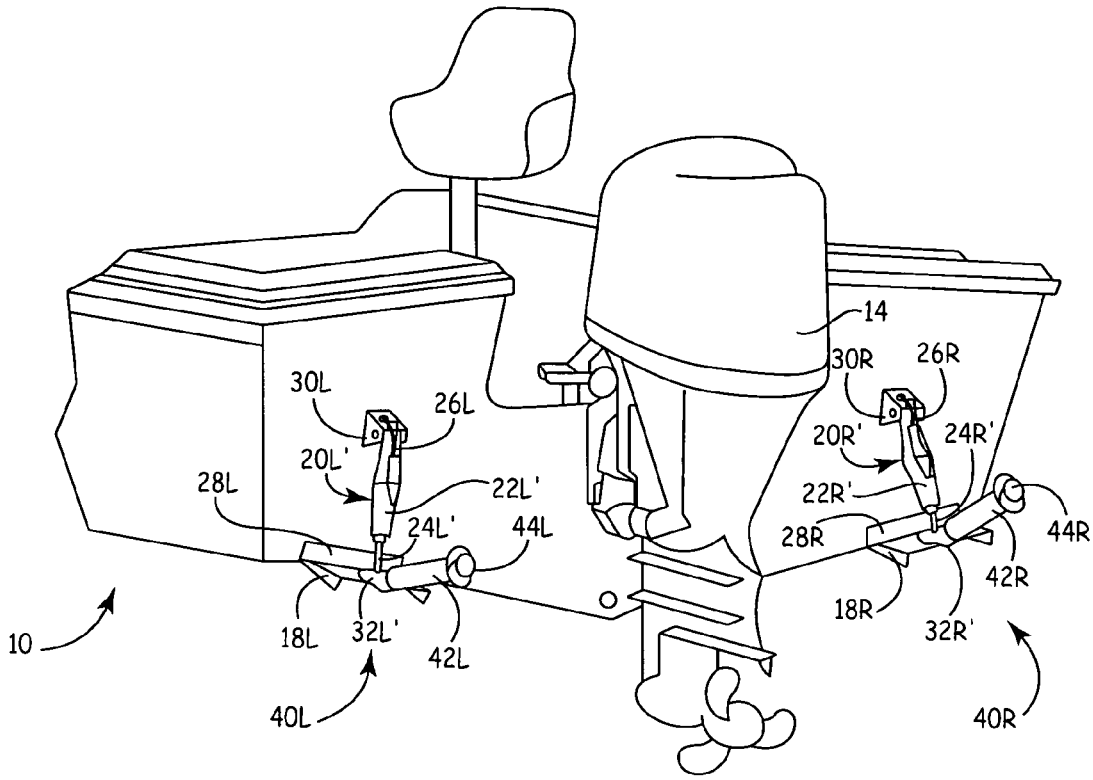
FIG. 1B is a perspective view of a boat with trim tabs mounted to the lower transom and electric trolling motors mounted on the trim tabs.

FIG. 1B shows the stem of boat 10 having a trim tab/trolling motor system that includes left trim tab/trolling motor assembly 40L and right trim tab/trolling motor assembly 40R. The embodiment shown in FIG. 1B, trim tab/trolling motor assemblies 40L and 40R are generally similar to trim tab assemblies 16L and 16R shown in FIG. 1A, and similar reference numerals are used to identify similar elements.

Assemblies 40L and 40R also include trolling motors 42L and 42R that are supported by trim tabs 18L and 18R, respectively. Lower mounts 32L and 32R, which connect to actuator rods 24L and 24R, are an integrated portion of trolling motors 42L and 42R, respectively. Thus mounts 32L and 32R in FIG. 1B mount trolling motors 42L and 42R to trim tabs 18L and 18R, respectively, as well as providing a connection to actuator rods 24L and 24R.

The trim tab/trolling motor system shown in FIG. 1B provides both a trimming function, and a trolling motor function. Trim tabs 18L and 18R operate in a trim range from about 0° to about 20° below horizontal. As in the embodiment shown in FIG. 1A, trim tabs 18L and 18R can be individually adjusted within the trim range, or can be adjusted together by equal amounts.

When trolling is desired, trim tabs 18L and 18R are moved to a troll range, which is below the trim range. The troll range may be, for example, between about 20° to about 30° below horizontal. Trim tabs 18L and 18R are moved together to the same angle within the troll range, so that both trolling motors 42L and 42R are at the same elevation. During trolling, trolling motors 42L and 42R are electrically driven so that their propellers 44L and 44R rotate. The relative speed and direction of rotation of propellers 44L and 44R can be controlled to achieve movement of boat 10 forward or in reverse and to achieve steering to the left or the right.

Figure 2A:
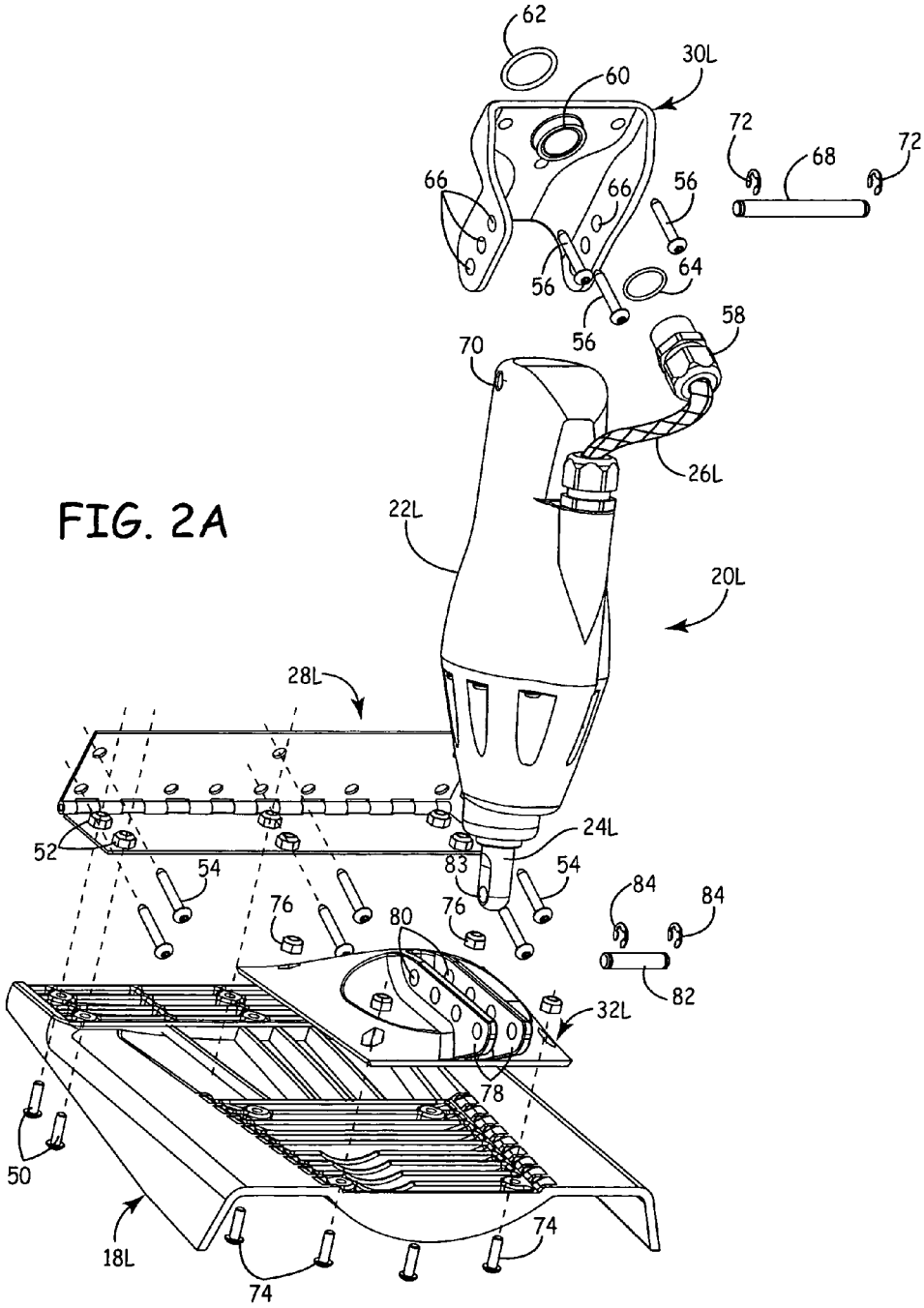
FIG. 2A is an exploded view of a trim tab assembly.

FIG. 2A shows an exploded view of trim tab assembly 16L. Trim tab assemblies 1L and 16R are identical, and therefore FIG. 2A is representative of both assemblies 16L and 16R.

Hinge 28L is attached to trim tab 18L by bolts 50 and nuts 52. Mounting screws 54 are used to attach hinge 28L to transom 22 of boat 10.

Upper mount 30L is attached to transom 12 by mounting screws 56. Fitting 58 is inserted into port 60 of mounting bracket 30L to provide a passage for cable 26L from actuator 20L through transom 12 to the interior of boat 10. O-rings 62 and 64 provide a seal around fitting 58.

Upper mounting bracket 30L includes three sets of actuator mounting holes 66. Mounting pin 68 extends through one of the sets of mounting holes 66 and through passage 70 in the upper end of actuator housing 22L to provide a pivotal connection between mounting bracket 30L and linear actuator 20L. C-clips 72 are attached to opposite ends of pin 68 to hold pin 68 in position.

Lower mount 32L is connected to trim tab 18L by bolts 74 and nuts 76. Lower mount 32L has a pair of flanges 78 with four sets of mounting holes 80. Mounting pin 82 extends through one of the pairs of holes 80 and through passage 83 in the lower end of actuator rod 24L. C-clips 84 hold mounting pin 82 in position. By selection of different combinations of mounting holes 66 and 80, linear actuators 20L of different lengths and variations in transom configuration can be accommodated.

FIGS. 2B-2E show actuator 20L' and trolling motor 42L of left trim tab/trolling motor assembly 40L, which is identical to right trim tab/trolling motor assembly 40R. Assembly 40L is generally similar to assembly 16L shown in FIG. 2A, except for the addition of trolling motor 42L and the use of longer actuator 20L'. Lower mount 32L' is an integrated portion of the housing of trolling motor 42L, but is shaped to fit in the same location as lower mount 32L of FIG. 2A. Bolts 74' and nuts 76 attach lower mount 32L' to trim tab 18L.

Figure 2B:
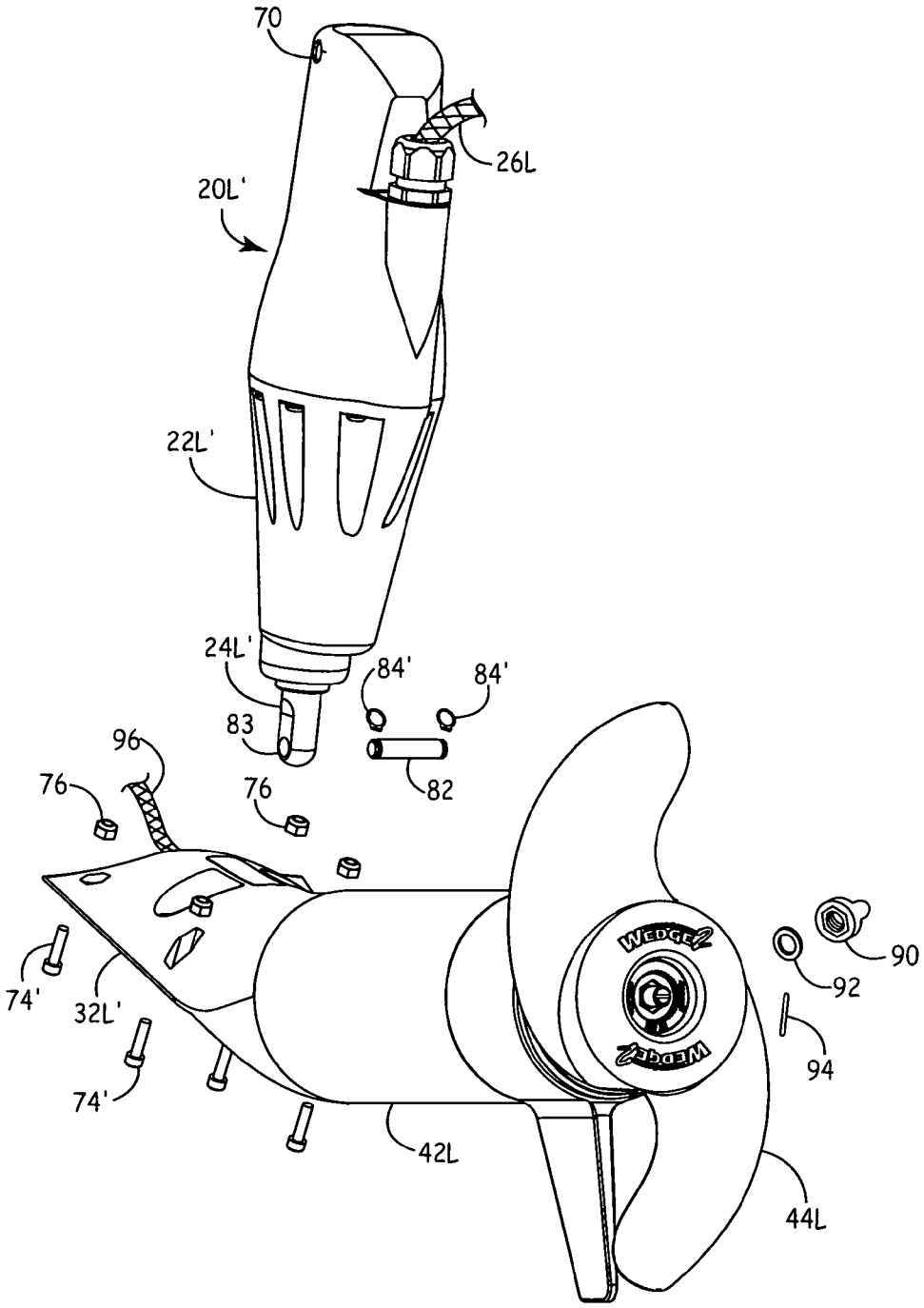
FIG. 2B is an exploded view of a trolling motor assembly for mounting on the trim tab assembly.

Actuator rod 24L' is pivotally connected to lower mount 32L' by pin 82. In the embodiment shown in FIG. 2A, only one set of mounting holes are provided for pin 82 in lower mount 32L'. Snap rings 84' hold pin 82 in place. Also shown in FIG. 2B are nut 90, washer 92, and pin 94, which are used to hold propeller 44L in place on the drive shaft of trolling motor 42L.

Figure 2E:
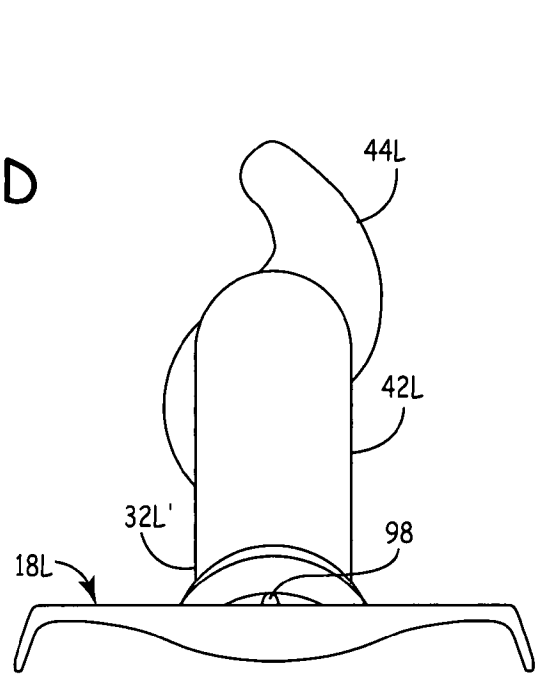
FIG. 2C-2E are sectional, top perspective, and front perspective views, respectively, of the trim tab and trolling motor of FIG. 2B.
Figure 2D:
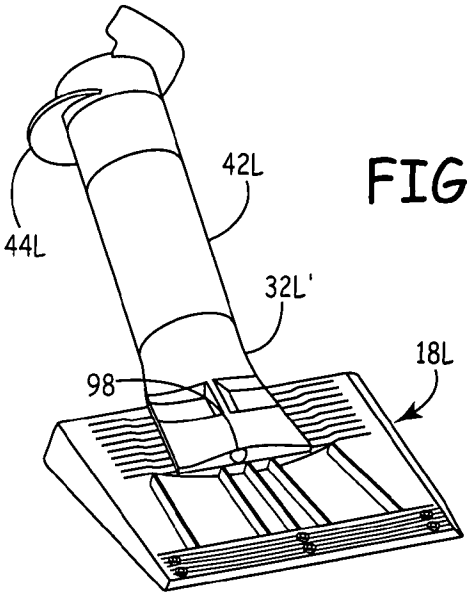
Figure 2C:
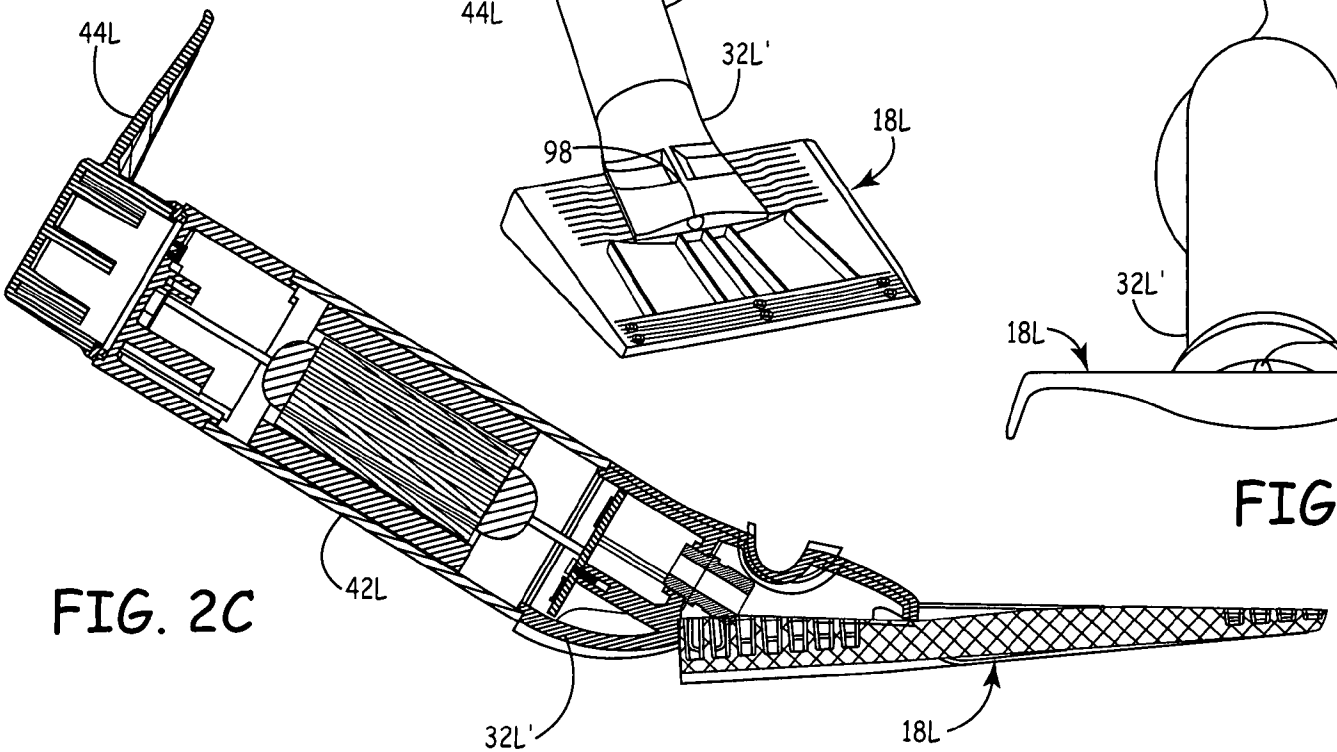

Motor power cable 96 exits lower mount 32L' through port 98. As shown in FIGS. 2D and 2E, port 98 is located at the forward end of lower mount 32L'. Motor power cable 96 extends through a fitting (not shown) in transom 12 into the interior of boat 10.

Boats vary in weight, length, speed, and performance, making the responsiveness of each boat unique. Therefore, the selection of size for trim tabs 18L and 18R is important in order to provide the performance and responsiveness. In the descriptions that follow, trim tabs of different sizes will be discussed. Two dimensions of interest are the chord length from the leading edge to the trailing edge of the trim tab, and the span, which is the distance from the inboard edge of the trim tab (nearest the center line of boat 10) and the outboard edge (furthest from the boat center line).

The embodiments shown in FIGS. 3A and 3B, 4A and 4B, 5A and 5B, 6A and 6B, 7A and 7B, and 8A and 8B show examples of trim tabs having two different chord lengths and three different spans. The trim tab shown in FIGS. 4A and 4B has the smallest chord length and span, and the trim tab in FIGS. 8A and 8B has the largest chord length and span.

Figure 3A:
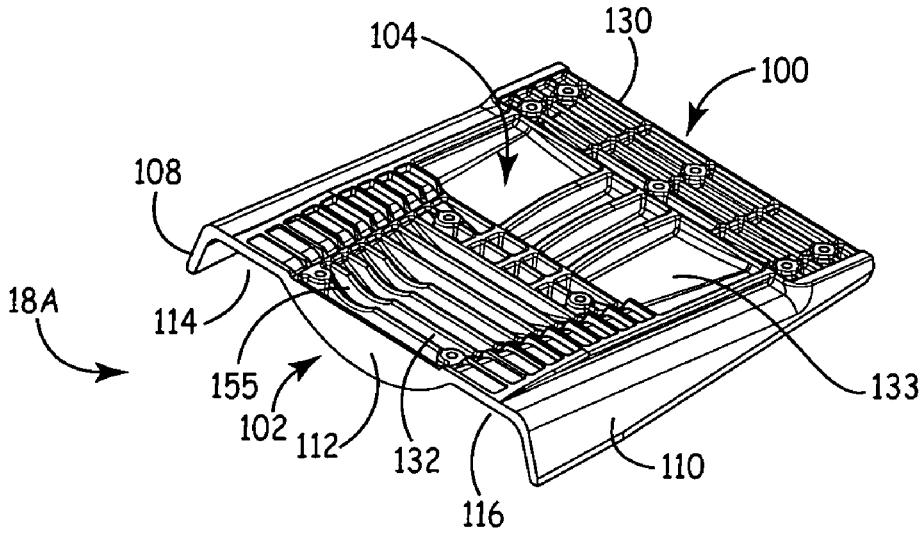
FIGS. 3A and 3B show top and bottom perspective views, respectively of first embodiment of a molded trim tab with contoured bottom surface.
Figure 3B:
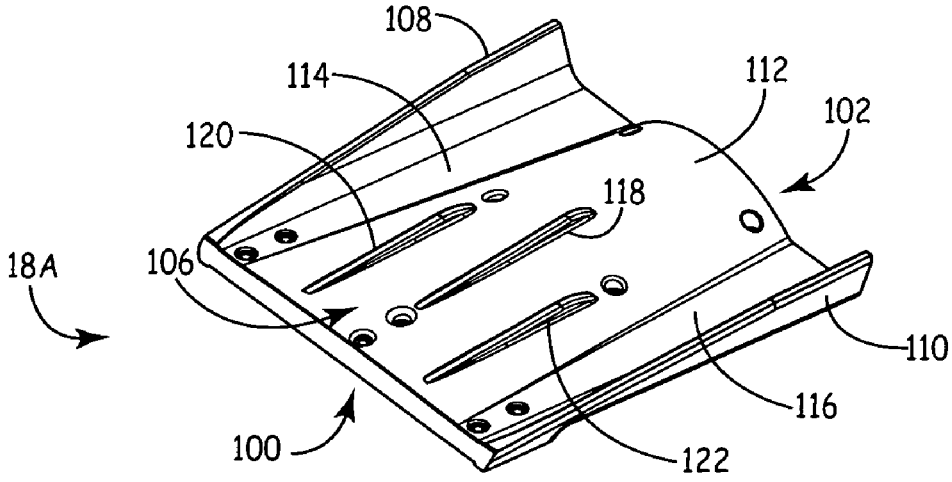
Figure 3C:
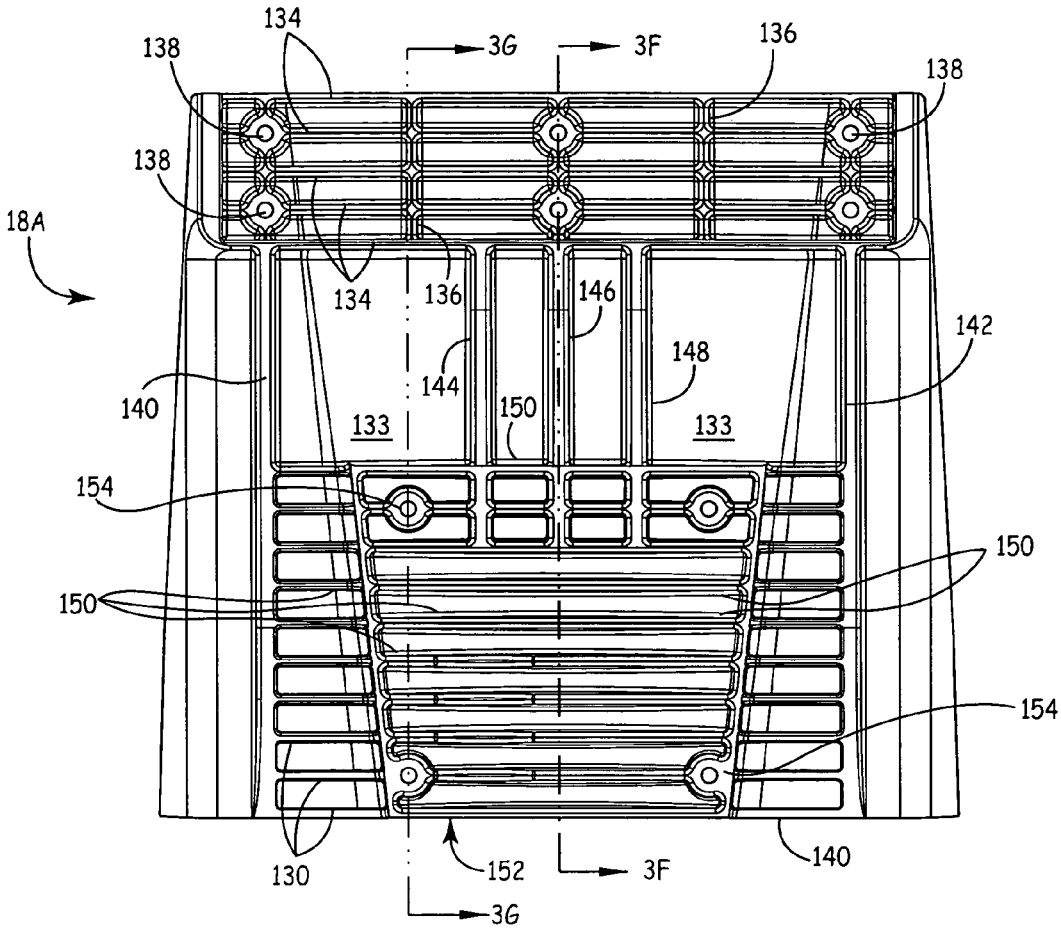
FIGS. 3C-3G show top, bottom, rear, and sectional views of the trim tab of FIGS. 3A and 3B.
Figure 3E:
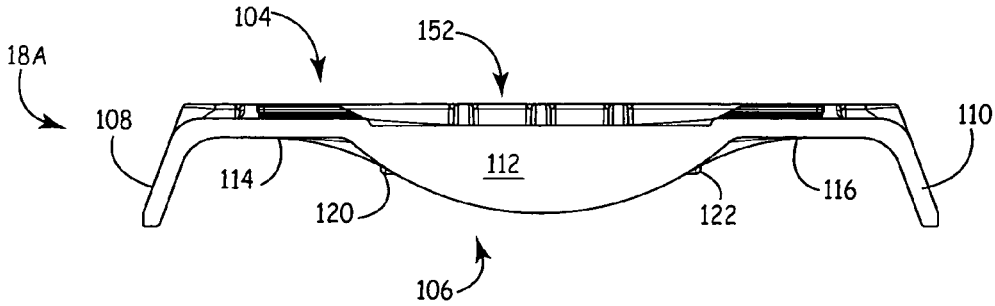
Figure 3D:
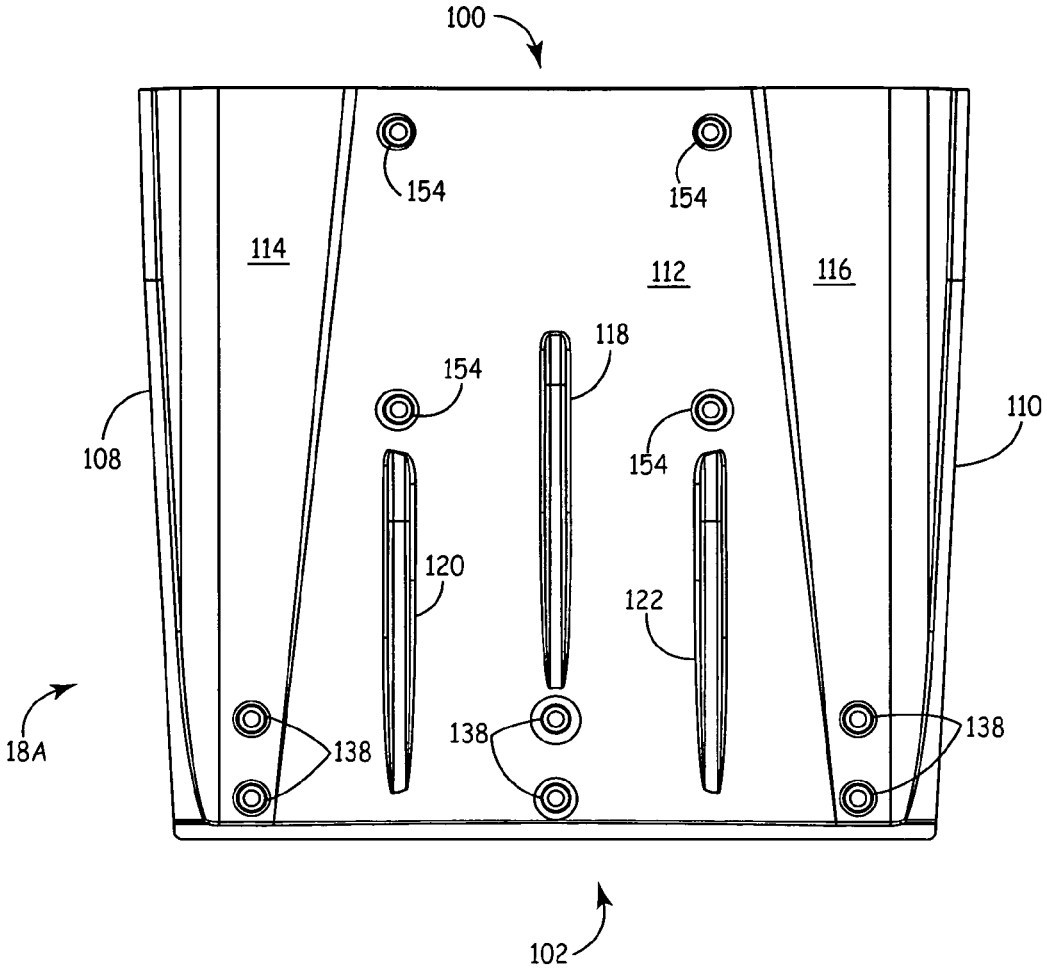
Figure 3F:
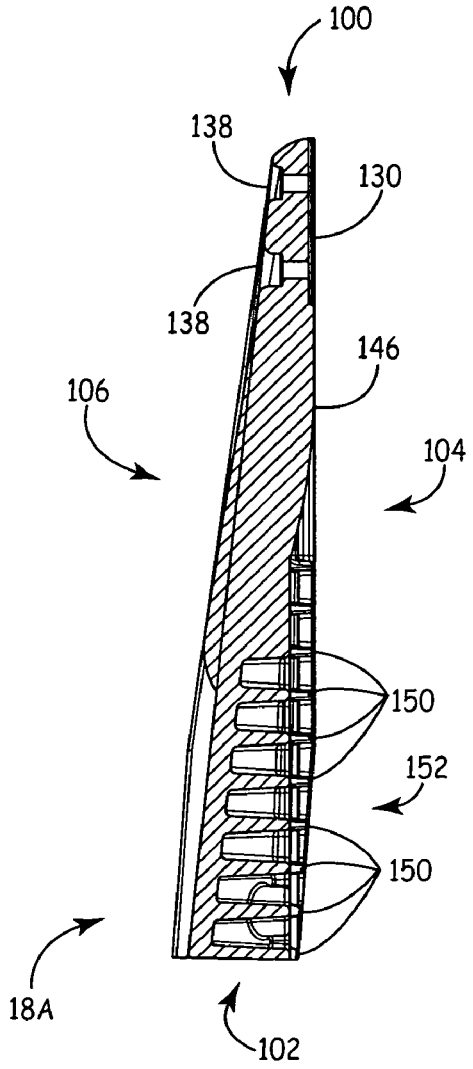
Figure 3G:
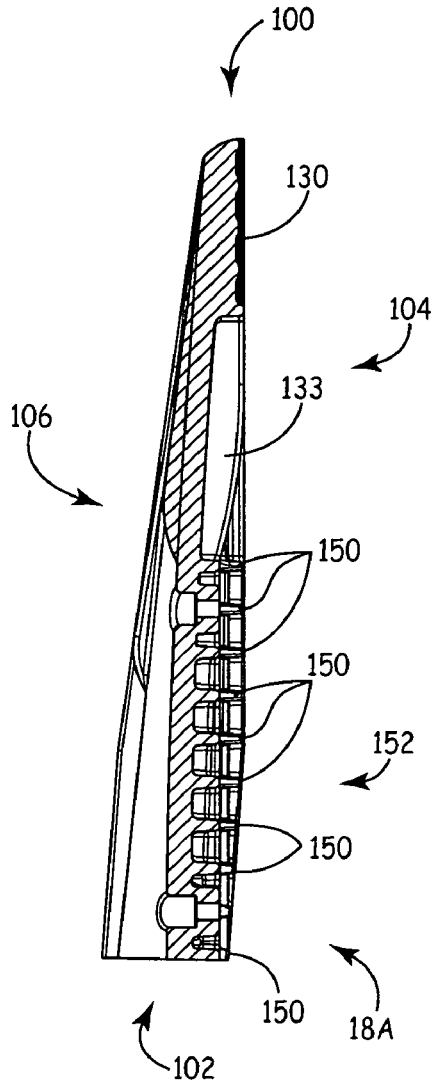

FIGS. 3A and 3B are top and bottom perspective views, respectively, of trim tab 18A, which is the smallest sized trim tab group of six different trim tab sizes shown in FIGS. 3A-8B. FIGS. 3C, 3D, and 3E are top, bottom, and rear views, and FIGS. 3F and 3G are sectional views of trim tab 18A. FIGS. 3A-3G will be discussed collectively in describing the structure of trim tab 18A. Trim tab 18A may be used on either the left side or right side of boat 10, and therefore may act as left trim tab 18L or right trim tab 18R in FIGS. 1A or 1B.

In one embodiment, trim tab 18A is an injection molded one piece trim tab formed of a polymeric material or a composite material that includes a polymeric material and a filler. For example, the polymeric material may be Plasticomp PA6-GF 50 that is 50% filled with long glass nylon. Carbon black may also be added to the polymer or the composite material to provide a black color. In other embodiments, other polymeric materials (with or without fillers) can be used, consistent with the strength requirements of the trim tabs. In still other embodiments, trim tab 18A may be manufactured using a cast metal process, and/or may include metal (e.g., aluminum or stainless steel) stumpings.

Trim tab 18A includes leading end 100, trailing end 102, top surface 104, bottom surface 106, and side flaps 108 and 110. Bottom surface 106, shown in FIG. 3B, includes convex central region 112 and concave side channels 114 and 116 positioned on opposite sides of convex central region 112. Flaps 108 and 110 define the outer lateral limits of concave side channels 114 and 116. Longitudinal ribs 118, 120, and 122 are located on convex region 112, and are generally positioned closer to leading end 100 than to trailing end 102. In some cases, longitudinal ribs may not be necessary depending upon the performance requirements of the trim tabs.

On top surface 104, hinge mounting platform 130 is located adjacent leading end 100. Lower mount platform 132 is located adjacent trailing end 102, and includes a pocket for receiving mount 32L, 32R, 32L', or 32R'. Top surface 104 has a concave center section 133 that matches the general contour of convex region 112 on bottom surface 106.

Hinge platform 130 includes a set of transverse ribs 134 and longitudinal ribs 136 that form a grid pattern. Mounting holes 138 extend through platform 130 to allow attachment of trim tab 18A to hinge 28L or 28R.

Longitudinal ribs 140 and 142 extend rearwardly from hinge platform 130 to trailing end 102. In addition, ribs 144, 146, and 148 extend rearwardly from hinge platform 130 to mount platform 132. Ribs 144, 146, and 148 are located in the concave portion 133 of top surface 104, with rib 146 being positioned along the center line of trim tab 18A, and ribs 144 and 146 being positioned equal distances on opposite sides of central rib 146.

Mount platform 132 includes parallel transverse ribs 150, which extend between longitudinal ribs 140 and 142. A trapezoidal section 152 of platform 132 is recessed to receive and locate lower mount 32L, 32R (or 32L', 32R'). Mounting holes 154 in recessed region 152 provide passages for the holes used to attach the lower mount to mount platform 132 of trim tab 18A. Recessed region 152 also includes a concave portion 155 that accommodates motor power cable 96 as it passes from motor 42L, 42R to port 98 at the front end of lower mount 34L', 34R'.

Transverse ribs 134 and 150 on top surface 104 also provide stiffening of trim tab 18A in the transverse or span direction. Longitudinal ribs 140, 142, 144, 146, and 148 provide stiffening of trim tab 18A in the longitudinal or chord direction. The use of molded ribs as part of trim tab 18A achieves stiffening without adding unnecessary weight. As a result, the benefits of use of a polymeric or composite material (such as ability to form complex shapes to enhance lift, ability to use injection molding to reduce manufacturing costs, corrosion resistance, and light weight) can be achieved. In some cases, transverse ribs may not be necessary depending upon the performance requirements of the trim tabs.

The contour of lower surface 106 provides increased surface area, in comparison to a flat plate. As a result, greater lift is achieved with trim tab 18A, than would be achieved with a flat plate trim tab having the same chord length and span.

Flaps 108 and 110 also assist in increasing lift by providing a lateral boundary to channels 114 and 116. Flaps 108 and 110 prevent water passing through channels 114 and 116 from spreading laterally outward and off the sides of trim tab 18A so that part of the lift effect is lost.

Convex region 112 has a minimum thickness at leading end 100 and has increased thickness or depth along the length until it reaches a maximum depth at trailing end 102. This provides a transition from the hull of boat 10 to trim tab 18A and channels 114 and 116 for water to flow without producing turbulence that could negate part of the lift effect of the trim tab.

Longitudinal ribs 118, 120, and 122 are also tapered so that they are of greater thickness at their trailing end then at their leading ends. Ribs 118, 120, and 122 provide additional strengthening to trim tab 18A without disrupting flow past bottom surface 106.

Flaps 108 and 110 extend generally downward and slightly outward. In one embodiment, the angle of flaps 108 and 110 with respect to the top plane defined by platforms 130 and 132 is about 70°. Flaps 108 and 110 are resilient and can deflect slightly outward during an operation, which can result in additional lift capability.

In one embodiment, trim tab 18A shown in FIGS. 3A-3G has a nominal size of about 9 inches by 9 inches. In other words, the chord length is about 9 inches, and the span is about 9 inches.

Figure 4A:
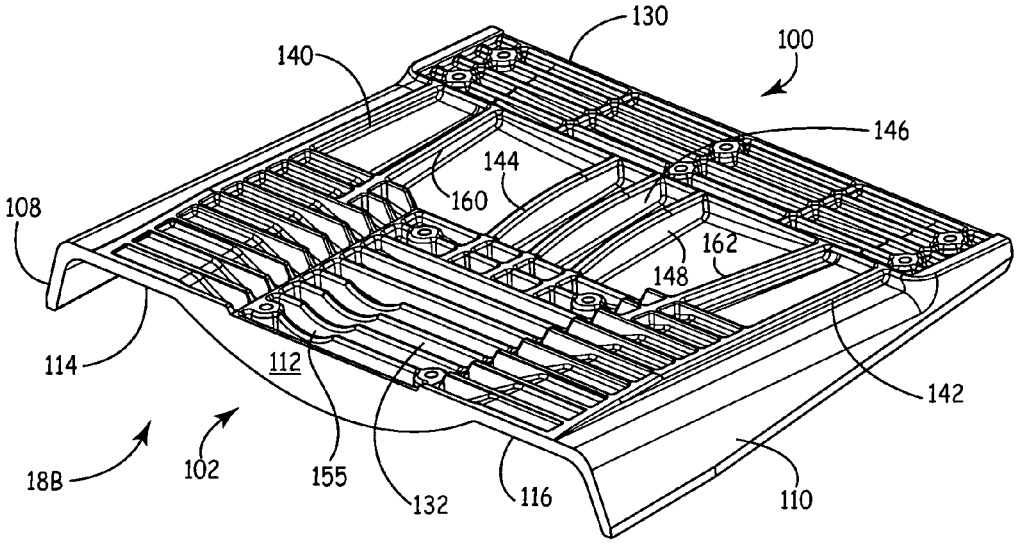
FIGS. 4A and 4B show top and bottom perspective views of a second embodiment of a trim tab having a similar chord length and greater span than the trim tabs of FIGS. 3A and 3B.
Figure 4B:
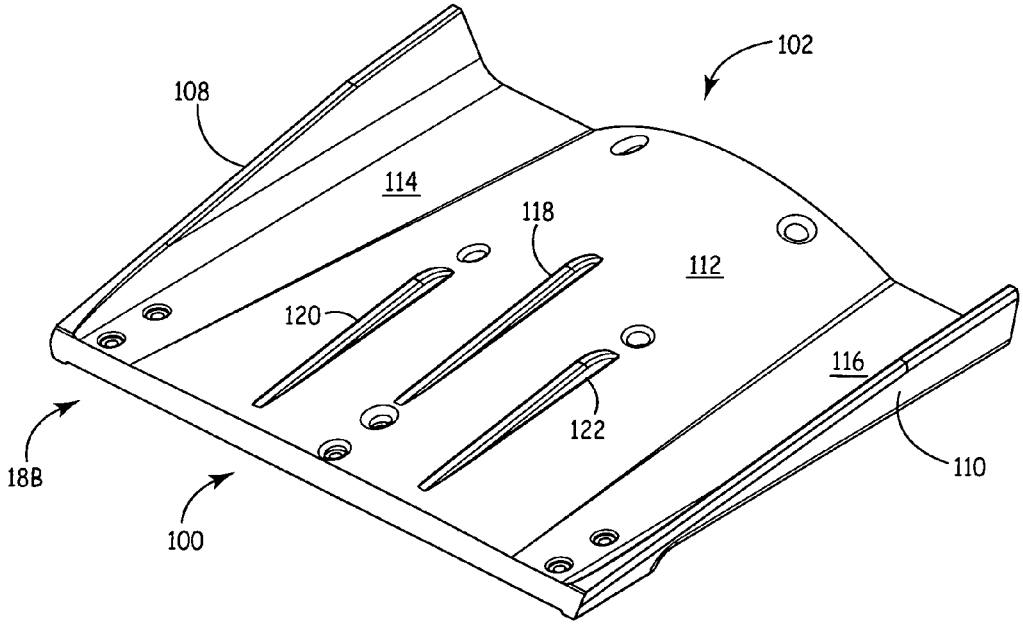

FIGS. 4A and 4B show trim tab 18B, which has a similar chord length to trim tab 18A, but a greater span. In one embodiment, trim tab 18B is a 9×12 trim tab having a nominal chord length of about 9 inches and a nominal span of about 12 inches.

Trim tab 18B is generally similar in structure to trim tab 18A, except that it includes two additional ribs 160 and 162 located within concave region 133 and generally follow the converging contour of region 133 as it extends from leading end to trailing end. Rib 160 is located between rib 140 and rib 144. Rib 162 is located between rib 142 and rib 148. Ribs 160 and 162 provide additional stiffening, generally in the longitudinal direction.

Figure 5A:
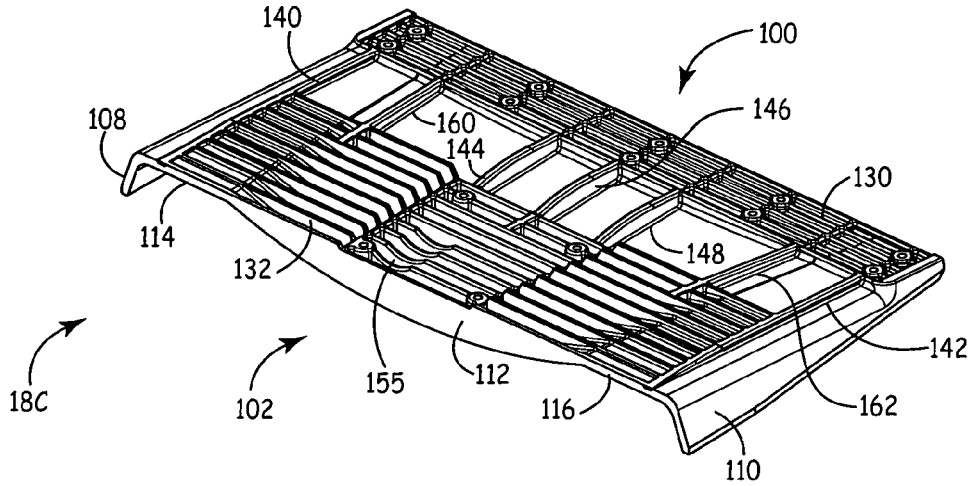
FIGS. 5A and 5B show top and bottom perspective views of a third embodiment of a trim tab having a similar chord length to trim tabs of FIGS. 3A and 3B and 4A and 4B, and having greater span.
Figure 5B:
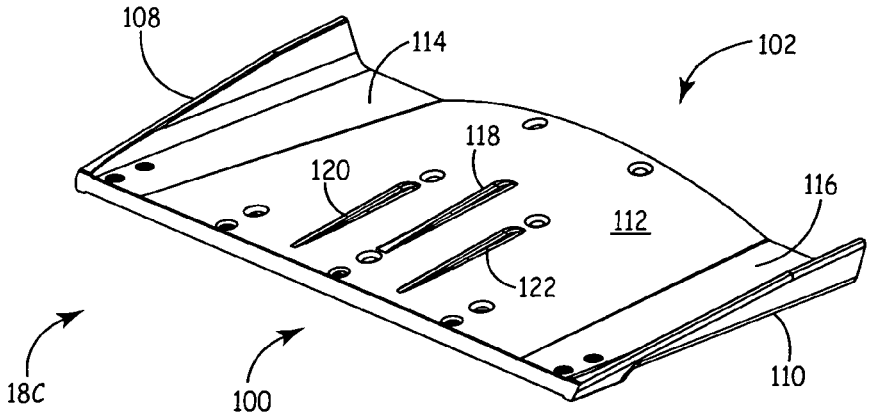

FIGS. 5A and 5B show top and bottom perspective views of trim tab 18C. Trim tab 18C has the same chord length as trim tab 18A and 18B, but has a larger span. In one embodiment, trim tab 18C has a nominal chord length of about 9 inches and a nominal span of about 18 inches.

The structure of trim tab 18C is generally similar to trim tab 18B, except for a greater span. As a result, ribs 140, 142, 144, 146, 148, 160, and 162 are spaced apart by larger distances.

Figure 6A:
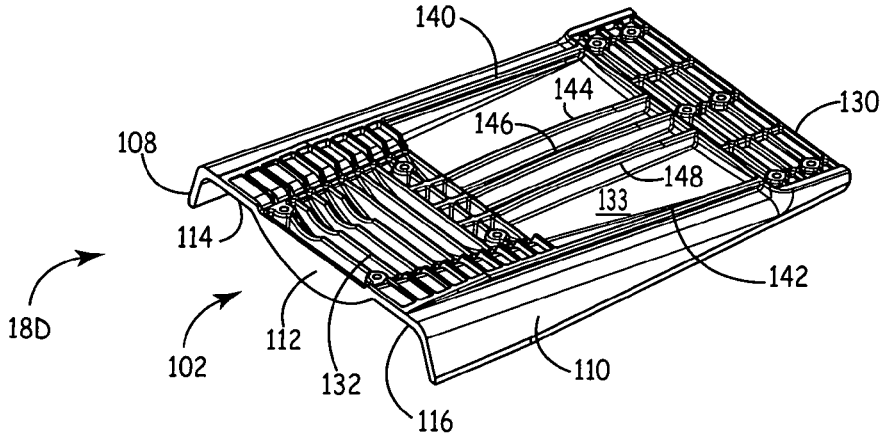
FIGS. 6A and 6B show top and bottom perspective views of a fourth embodiment of a trim tab having a span similar to the trim tabs of FIGS. 3A and 3B and having a greater chord length.
Figure 6B:
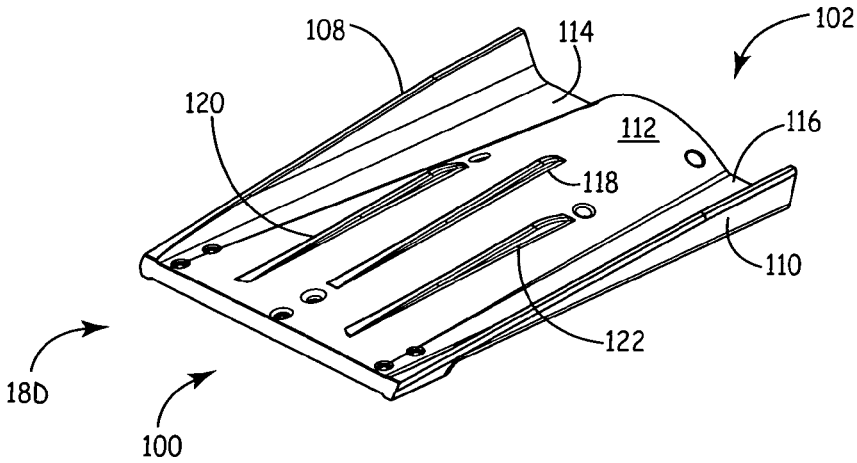

FIGS. 6A and 6B are top and bottom perspective views of trim tab 18D, which has the same span as trim tab 18A, but has a longer chord length. In one embodiment, trim tab 18D has a nominal chord length of about 12 inches and a nominal span of about 9 inches.

Platform areas 130 and 132 of trim tab 18D are similar to platform areas 130 and 132 of trim tab 18A. Ribs 140, 142, 144, 146, and 148 are longer in trim tab 18D, to accommodate the longer chord length. Bottom ribs 118, 120, and 122 are also longer in trim tab 18D than trim tab 18A.

Figure 7A:
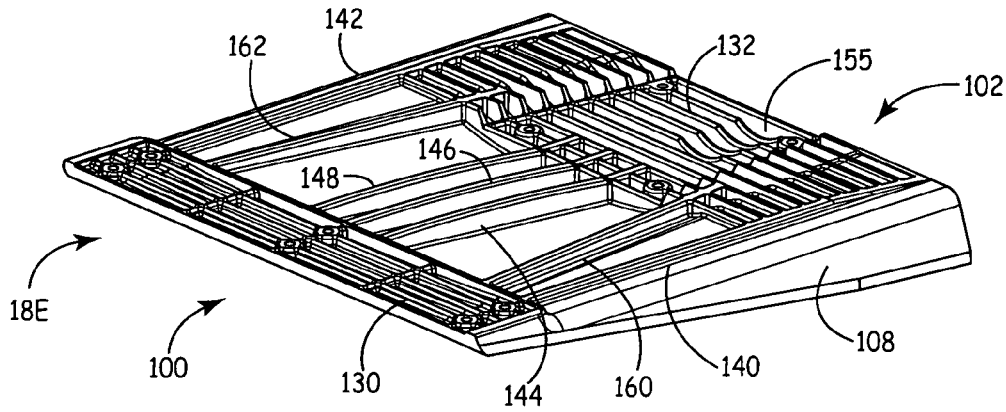
FIGS. 7A and 7B show top and bottom perspective views of a fifth embodiment of a trim tab having a chord length similar to the trim tabs of FIGS. 6A and 6B and having a span similar to the trim tabs of FIGS. 4A and 4B.
Figure 7B:
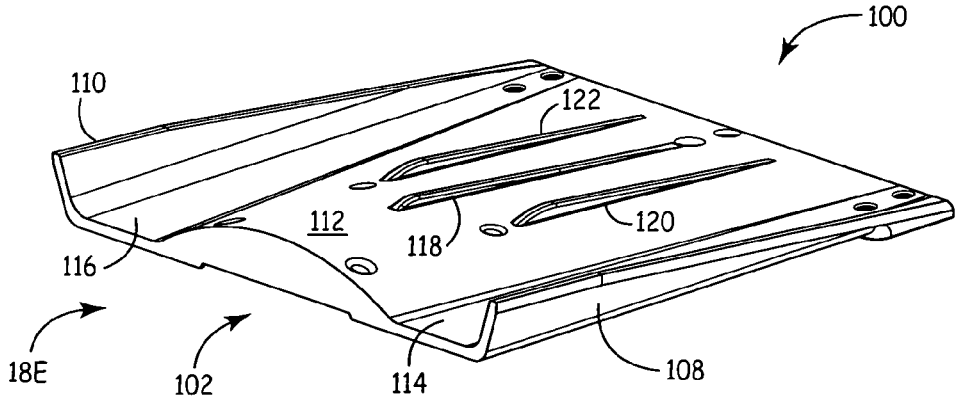

FIGS. 7A and 7B are top and bottom perspective views of trim tab 18E has a span which is similar to trim tab 18B, and a chord length similar to trim tab 18D. The same rib structure is provided in trim tab 18E as in trim tab 18B, but the lengths of the longitudinal ribs are greater because of the longer chord length. In one embodiment, trim tab 18E has a nominal chord length of about 12 inches and a nominal span of about 12 inches.

Figure 8A:
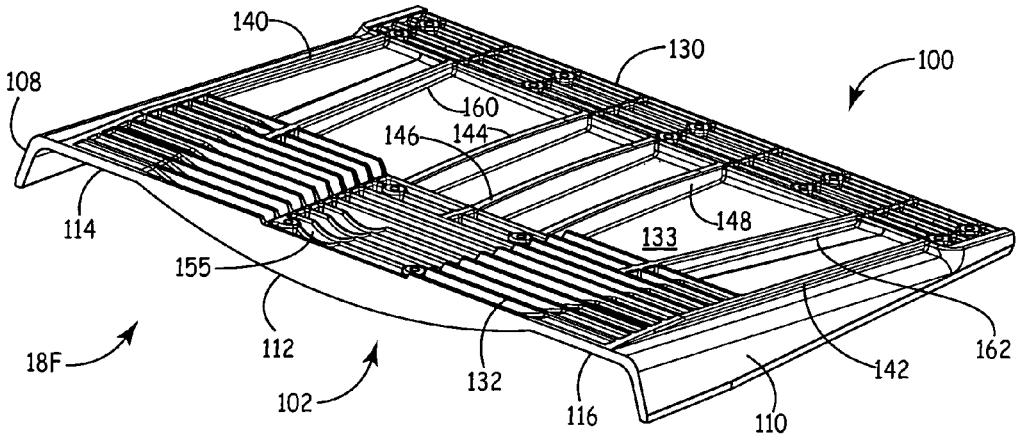
FIGS. 8A and 8B show top and bottom perspective views of a sixth embodiment of a trim tab having chord length similar to the trim tabs of FIGS. 6A and 6B and 7A and 7B, and having a span similar to the trim tabs of FIGS. 5A and 5B.
Figure 8B:
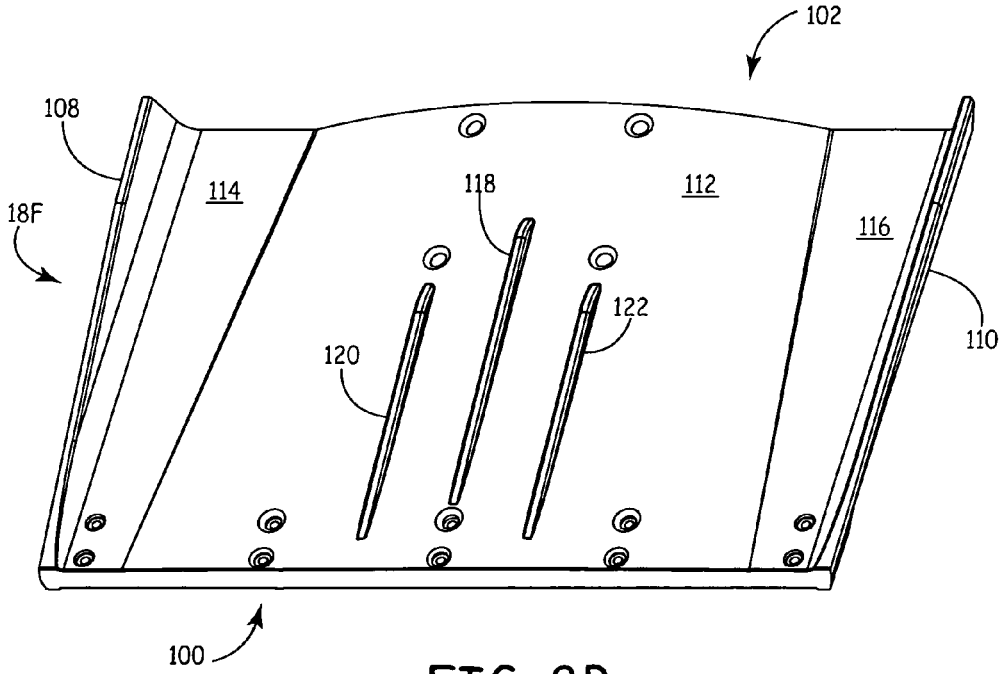

FIGS. 8A and 8B show top and bottom perspective views of trim tab 18F, which has the same span as trim tab 18C and the same chord lengths as trim tabs 18D and 18E. The rib in trim tab 18F is similar to that shown in trim tab 18C. The lengths of the longitudinal ribs are greater to accommodate the greater chord length of trim tab 18F. Trim tab 18F may have a nominal chord length of about 12 inches and a nominal span length of about 18 inches.

As illustrated by trim tabs 18A-18F, wide range of different trim tab sizes can be achieved using the same basic trim tab design. In each trim tab, the bottom surface has a contour that includes a central convex region and concave side channels located between the concave region and the side flaps. As a result, each of the trim tabs 18A-18F provides enhanced lift characteristics, while offering a lightweight structure. In some cases, the use of longitudinal ribs on both top surface 104 and bottom surface 102, and transverse ribs on top surface 104 can provide stiffening to ensure structural integrity without sacrificing the benefits of the trim tab structure.

Although the present invention has been described with reference to preferred embodiments, workers skilled in the art will recognize that changes may be made in form and detail without departing from the spirit and scope of the invention.

The invention claimed is:

1. A trim tab comprising:

a front end;

a rear end;

a first side;

a second side;

a top surface extending between the front end and the rear end; and a bottom surface extending between the front end and the rear end, the bottom surface including a longitudinally extending convex central region and first and second concave channels extending longitudinally on opposite sides of the convex central region;

a plurality of transverse ribs on the top surface;

a plurality of longitudinal ribs on the top surface extending a substantial portion of the length between the front end and the rear end; and wherein the plurality of longitudinal ribs include first and second longitudinal ribs on the top surface above the first and second concave channels, respectively.

2. The trim tab of claim 1 and further comprising:

a first side flap extending longitudinally along the first side; and a second side flap extending longitudinally along the second side.

3. The trim tab of claim 1, wherein first and second side flaps are downturned and have a greater height at the rear end than at the front end.

4. The trim tab of claim 1 and further comprising:

a hinge connection platform on the top surface adjacent the front end; and a mount connection platform on the top surface adjacent the rear end.

5. The trim tab of claim 1, wherein the plurality of transverse ribs include transverse ribs adjacent the front end, and transverse ribs adjacent the rear end.

6. The trim tab of claim 1, wherein the plurality of longitudinal ribs include at least one longitudinal rib on the top surface above the convex central region of the bottom surface.

7. The trim tab of claim 1, wherein the trim tab is a one-piece molded body of a polymeric or composite material.

8. The trim tab of claim 1, wherein the top surface includes a concave region overlying the convex central region of the bottom surface.

9. A trim tab comprising:

a front end;

a rear end;

a first side;

a second side;

a top surface extending between the front end and the rear end; and a bottom surface extending between the front end and the rear end, the bottom surface including a longitudinally extending convex central region and first and second concave channels extending longitudinally on opposite sides of the convex central region; and wherein the convex central region is tapered from a wider and thinner forward portion adjacent the front end to a narrower and thicker rearward portion adjacent the rear end.

10. The trim tab of claim 9, wherein each of the first and second concave channels is tapered from a narrower and shallower forward end adjacent the front end to a wider and deeper rearward end adjacent the rear end.

11. A trim tab comprising:

a body having a front end, a rear end, a first side, a second side, a top surface, an undulating bottom surface, a first side flap extending downward along the first side, and a second side flap extending downward along the second side;

wherein the undulating bottom surface includes a longitudinally extending convex central region, and longitudinally extending concave channels on opposite sides of the convex central region; and wherein the convex central region is tapered from a wider and thinner forward portion adjacent the front end to a narrower and thicker rearward portion adjacent the rear end.

12. A trim tab comprising:

a body having a front end, a rear end, a first side, a second side, a top surface, an undulating bottom surface, a first side flap extending downward along the first side, and a second side flap extending downward along the second side;

wherein the undulating bottom surface includes a longitudinally extending convex central region, and longitudinally extending concave channels on opposite sides of the convex central region;

a plurality of transverse ribs on the top surface; and a plurality of longitudinal ribs on the top surface extending a substantial portion of the length between the front end and the rear end, wherein the plurality of longitudinal ribs include first and second longitudinal ribs on the top surface above each concave channel, respectively.

13. The trim tab of claim 12, wherein the top surface includes a concave region overlying the convex central region of the bottom surface.

14. The trim tab of claim 12, wherein each of the concave channels is tapered from a narrower and shallower forward end adjacent the front end to a wider and deeper rearward end adjacent the rear end.

15. The trim tab of claim 12 and further comprising:

at least one longitudinal rib on the top surface above the convex central region of the bottom surface.

16. The trim tab of claim 12, wherein the plurality of transverse ribs include transverse ribs adjacent the front end, and transverse ribs adjacent the rear end.

17. The trim tab of claim 12, wherein the body is formed of one of: molded polymeric material, molded composite material, and stamped metal.

18. The trim tab of claim 12 and further comprising:

a hinge connection platform on the top surface adjacent the front end; and a mount connection platform on the top surface adjacent the rear end.

19. The trim tab of claim 12, wherein the flaps extend downward and outward.

20. The trim tab of claim 12, wherein the flaps are oriented at a depression angle of about 70°.

* * * * *